US012559925B2

(12) United States Patent
Lin et al.

(10) Patent No.: US 12,559,925 B2
(45) Date of Patent: Feb. 24, 2026

(54) HEATING DEVICE, SANITARY WATER SUPPLY DEVICE, AND SANITARY CLEANING DEVICE

(71) Applicant: Komoo Intelligent Technology Co., Ltd., Fujian (CN)

(72) Inventors: Xiaofa Lin, Fujian (CN); Xiaoshan Lin, Fujian (CN); Shan Lin, Fujian (CN); Zuhua Liu, Fujian (CN); Yanxin Xu, Fujian (CN)

(73) Assignee: Komoo Intelligent Technology Co., Ltd., Xiamen (CN)

( * ) Notice: Subject to any disclaimer, the term of this patent is extended or adjusted under 35 U.S.C. 154(b) by 960 days.

(21) Appl. No.: 17/688,286

(22) Filed: Mar. 7, 2022

(65) Prior Publication Data

US 2022/0186480 A1 Jun. 16, 2022

Related U.S. Application Data

(63) Continuation of application No. PCT/CN2020/091006, filed on May 19, 2020.

(51) Int. Cl.

| | |
|---|---|
| ***E03D 9/08*** | (2006.01) |
| ***F24H 1/10*** | (2022.01) |
| ***F24H 9/18*** | (2022.01) |

(52) U.S. Cl.

CPC ..... *E03D 9/08* (2013.01); *F24H 1/10* (2013.01); *F24H 9/18* (2013.01)

(58) Field of Classification Search

CPC ..... E03D 9/08; F24H 1/10; F24H 9/18
USPC ..... 392/485
See application file for complete search history.

(56) References Cited

U.S. PATENT DOCUMENTS

2012/0201525 A1 8/2012 Park et al.

FOREIGN PATENT DOCUMENTS

| | | | |
|---|---|---|---|
| CN | 201028749 | Y | 2/2008 |
| CN | 201088533 | Y | 7/2008 |
| CN | 102012091 | A | 4/2011 |
| CN | 102469635 | A | 5/2012 |
| CN | 104420525 | A | 3/2015 |
| CN | 204703238 | U | 10/2015 |
| CN | 105066430 | A | 11/2015 |

(Continued)

OTHER PUBLICATIONS

International Search Report and English Translation cited in PCT/CN2020/091006, mailed Aug. 17, 2020, 7 pages.

(Continued)

*Primary Examiner* — Phuong T Nguyen
(74) *Attorney, Agent, or Firm* — Cooper Legal Group, LLC

(57) ABSTRACT

Disclosed are a heating device, a sanitary water supply device, and a sanitary cleaning device. The heating device comprises a main body and one or more ceramic heating plates. The main body comprises a heating cavity, and the one or more ceramic heating plates are disposed in the heating cavity to define a heating channel within the heating cavity. A first water inlet is defined at a first end of the heating channel, and a first water outlet is defined at a second end of the heating channel. The one or more ceramic heating plates comprise a first heating surface and a second heating surface facing away from each other, and a flow direction of cleaning water in the heating channel is along the first heating surface and the second heating surface in sequence.

17 Claims, 13 Drawing Sheets

(56) References Cited

FOREIGN PATENT DOCUMENTS

| | | | | | |
|---|---|---|---|---|---|
| CN | 205458350 | U | | 8/2016 | |
| CN | 206540297 | U | * | 10/2017 | ..... A47K 13/30 |
| CN | 108954849 | A | * | 12/2018 | ..... F24H 9/2007 |
| CN | 208563503 | U | | 3/2019 | |
| CN | 109972704 | A | | 7/2019 | |
| CN | 110604501 | A | | 12/2019 | |
| CN | 110645699 | A | | 1/2020 | |
| CN | 211041377 | U | | 7/2020 | |
| CN | 211582860 | U | | 9/2020 | |
| EP | 2505728 | A2 | | 10/2012 | |
| JP | H0614281 | U | | 2/1994 | |
| JP | 2008275283 | A | | 11/2008 | |
| JP | 2010031637 | | | 2/2010 | |
| JP | 2010065455 | A | | 3/2010 | |
| JP | 2016199931 | A | | 12/2016 | |
| KR | 200473075 | Y1 | | 6/2014 | |
| KR | 200473076 | Y1 | | 6/2014 | |
| KR | 20150114624 | A | | 10/2015 | |
| WO | 2009155852 | A1 | | 12/2009 | |
| WO | 2014010142 | A1 | | 1/2014 | |

OTHER PUBLICATIONS

Written Opinion cited in PCT/CN2020/091006, mailed Aug. 17, 2020, 5 pages.

Notification of Grant cited in CN201910926121.1, mailed Aug. 15, 2024, 3 pages.

First Office Action cited in CN201910926121.1, mailed Dec. 7, 2023, 8 pages.

Second Office Action cited in CN201910926121.1, mailed Mar. 26, 2024, 8 pages.

Third Office Action cited in CN201910926121.1, mailed May 28, 2024, 15 pages.

Notification of Grant cited in CN201910926123.0, mailed Apr. 3, 2025, 3 pages.

First Office Action cited in CN201910926123.0, mailed Oct. 16, 2024, 10 pages.

Notification of Grant cited in EP20868783, mailed May 14, 2025, 7 pages.

First Office Action cited in EP20868783, mailed Feb. 15, 2024, 5 pages.

European Search Report cited in EP20868783, mailed Feb. 5, 2024, 4 pages.

Notification of Grant cited in JP2022-513543, mailed Feb. 20, 2024, 5 pages.

First Office Action cited in JP2022-513543, mailed May 24, 2023, 7 pages.

Second Office Action cited in JP2022-513543, mailed Nov. 2, 2023, 4 pages.

Notification of Grant cited in KR2022-7007905, mailed Mar. 29, 2024, 6 pages.

First Office Action cited in KR2022-7007905, mailed Sep. 5, 2023, 17 pages.

* cited by examiner

HEATING DEVICE, SANITARY WATER SUPPLY DEVICE, AND SANITARY CLEANING DEVICE

RELATED APPLICATIONS

This application is a continuation of and claims priority to International patent application number PCT/CN2020/091006, filed May 19, 2020, which claims priority to Chinese patent application number 201910926121.1, filed on Sep. 27, 2019, and Chinese patent application number 201910926123.0, filed on Sep. 27, 2019. International patent application number PCT/CN2020/091006, Chinese patent application number 201910926121.1, and Chinese patent application number 201910926123.0 are incorporated herein by reference.

FIELD OF THE DISCLOSURE

The present disclosure relates to the field of sanitary ware, and in particular to a heating device, a sanitary water supply device, and a sanitary cleaning device.

BACKGROUND OF THE DISCLOSURE

Cleaning water of traditional sanitary cleaning devices used for hip washing and/or feminine washing needs to be heated to a suitable temperature by a heating device and then output. The heating device generally uses a ceramic heating plate as a heater, and the cleaning water only flows along a single-side heating surface of the ceramic heating plate and then is output, which results in a short heating distance for the cleaning water, and the cleaning water cannot be fully and uniformly heated. For this reason, a heating device in the prior art comprises ribs arranged between the ceramic heating plate and a main body of the heating device, so that an S-shaped heating channel is formed between the ceramic heating plate and the main body. This method extends the heating distance of the cleaning water. However, due to the ribs being attached to the heating surface of the ceramic heating plate, a certain heating area of the ceramic heating plate is occupied, resulting in low heating efficiency of the ceramic heating plate.

BRIEF SUMMARY OF THE DISCLOSURE

The present disclosure provides a sanitary water supply device and sanitary cleaning device that can improve a heating efficiency of ceramic heating plates in view of the deficiencies existing in the background.

In order to solve the technical problem, a first technical solution of the present disclosure is as follows.

A heating device comprises a main body and one or more ceramic heating plates. The main body comprises a heating cavity, and the one or more ceramic heating plates are disposed in the heating cavity to define a heating channel within the heating cavity. A first end of the heating channel has a first water inlet, and a second end of the heating channel has a first water outlet. The one or more ceramic heating plates comprise a first heating surface and a second heating surface which face away from each other, and a flow direction of cleaning water in the heating channel is along the first heating surface and the second heating surface in sequence.

In a preferred embodiment, the one or more ceramic heating plates are a plurality of ceramic heating plates, and the plurality of ceramic heating plates are disposed side by side. One of one or more partitions is disposed between a respective two, which are adjacent to each other, of the plurality of ceramic heating plates to make the heating channel that is serpentine-shaped surrounding each of the plurality of ceramic heating plates.

In a preferred embodiment, the plurality of ceramic heating plates are in a standing state, and a water inlet structure and a water outlet structure are located on a side surface of the heating cavity.

In a preferred embodiment, a top end of the heating cavity has an opening, an end cover is connected to the main body, and the end cover is configured to close the opening.

In a preferred embodiment, a bottom surface of the heating cavity comprises a plurality of first positioning grooves disposed side by side, and a bottom surface of the end cover comprises a plurality of second positioning grooves disposed side by side. Bottom portions of the plurality of ceramic heating plates are disposed in the plurality of first positioning grooves in a one to one correspondence, and top portions of the plurality of ceramic heating plates are disposed in the plurality of second positioning grooves in a one to one correspondence. Top portions of the one or more partitions are fixed to the end cover, and bottom portions of the one or more partitions are disposed in one or more third positioning grooves defined on the bottom surface of the heating cavity.

In a preferred embodiment, the main body comprises a water outlet cavity which is in communication with the first water outlet, the end cover comprises a water passage, and a first end of the water passage is in communication with the water outlet cavity.

In a preferred embodiment, a side surface of the main body comprises a heat source installation port in communication with the heating cavity and used for receiving the one or more ceramic heating plates; or the first water outlet is located at or above a center of a second end of the heating channel, and is located on a side surface of the second end of the heating channel.

In a preferred embodiment, the flow direction of the cleaning water in the heating channel is along a length direction of the first heating surface and a length direction of the second heating surface in sequence.

In a preferred embodiment, the main body is a water tank, and the water tank comprises a water storage cavity that is configured to receive the cleaning water. The first water inlet of the heating channel is in communication with the water storage cavity, and the water tank, the water storage cavity, and the heating cavity are of an integrated structure.

In a preferred embodiment, the heating cavity is located at a top of the water tank, and the water tank comprises a water pumping pipe. A first end of the water pumping pipe is in communication with the first water inlet of the heating channel, and a second end of the water pumping pipe extends into the water storage cavity. The second end of the water pumping pipe is lower than a lowest water level line of the water storage cavity.

In a preferred embodiment, the second end of the water pumping pipe is higher than a self-cleaning water outlet provided by a spray cleaning device of a sanitary cleaning device comprising the heating device.

In a preferred embodiment, a top of the water storage cavity surrounds or partially surrounds the heating cavity, and a highest water level line of the water storage cavity is higher than a bottom end of the heating cavity.

In a preferred embodiment, the water tank comprises an overflow pipe. A top end of the overflow pipe comprises an overflow port located in the water storage cavity, and a bottom end of the overflow pipe comprises a drain port leading to outside of the water tank.

In a preferred embodiment, the water tank comprises a water inlet pipe. A first end of the water inlet pipe comprises a second water outlet located in the water storage cavity, and a second end of the water inlet pipe comprises a second water inlet leading to outside of the water tank. The second water outlet is higher than the overflow port.

A second technical solution of the present disclosure is as follows.

A sanitary water supply device comprises a water tank for receiving water, a water pump, and the heating device. The cleaning water received in the water tank is configured to be pumped by the water pump to the heating device and to be output.

A third technical solution of the present disclosure is as follows.

A sanitary water supply device, comprises a water pump and the heating device. The cleaning water received in the water storage cavity is configured to be pumped by the water pump to the heating cavity and to be output.

A fourth technical solution of the present disclosure is as follows.

A sanitary cleaning device comprises a spray cleaning device and the sanitary water supply device. The spray cleaning device is disposed on a downstream side of the water pump.

Compared with the existing techniques, the technical solution has the following advantages.

1. Since the flow direction of the cleaning water in the heating channel is along the first heating surface and the second heating surface in sequence, the present disclosure enables a flow of the cleaning water to sequentially flow along the heating surfaces on both sides of each of one or more the ceramic heating plates (i.e., the first heating surface and the second heating surface), thereby not only increasing a heating distance of the cleaning water in the heating cavity so as to evenly and fully heat the cleaning water in the heating cavity, but also enabling the one or more ceramic heating plates to be completely immersed in the cleaning water, which improves a heating efficiency of the one or more ceramic heating plates. In addition, the heating channel surrounds the first heating surface and the second heating surface of one or more of the ceramic heating plates, so that a cross-sectional area of the heating channel is larger, and the heating channel is not easily blocked by scale due to long-term use.

2. The one or more ceramic heating plates are the plurality of ceramic heating plates, and the plurality of ceramic heating plates are arranged side by side. One of the one or more partitions is between a respective two of the plurality of ceramic heating plates which are adjacent to each other, so that the heating channel that is serpentine-shaped surrounding each of the plurality of ceramic heating plates, thereby further extending a heating distance of the cleaning water, so that the cleaning water is heated more uniformly and fully.

3. The setting of the end cover makes the positioning of the one or more ceramic heating plates more convenient and reliable, and at the same time facilitates later maintenance and regular removal of scale.

4. The main body is the water tank, so that the water tank can be integrated with the heating device, which not only reduces the parts and assembly steps of the heating device to save costs, but also makes an overall structure of the sanitary cleaning device using the water tank more concise and occupy a smaller space.

5. The heating cavity is located at the top of the water tank and is in communication with the water storage cavity through the water pumping pipe, which can prevent the heating cavity from always holding the cleaning water, so as to prevent the one or more ceramic heating plates in the heating cavity from being immersed in the cleaning water in a non-working state, thereby making the one or more ceramic heating plates less prone to scaling.

6. The top of the water storage cavity surrounds or partially surrounds the heating cavity, and the highest water level of the water storage cavity is higher than the bottom end of the heating cavity, which can not only use an external heat dissipation from the heating cavity to preheat the cleaning water (i.e., at a room temperature) held in the water storage cavity so as to make full use of the external heat dissipation of the heating cavity and achieve energy saving, but also can enable the cleaning water at the room temperature in the water storage cavity to be used to protect the one or more ceramic heating plates in the heating cavity under abnormal heating conditions.

7. The arrangement of the overflow pipe enables the water tank of the present disclosure to have overflow and exhaust functions. The water inlet surface of the water inlet pipe is higher than the overflow surface of the overflow pipe, so that the water tank of the present disclosure also has an anti-siphon function to prevent the cleaning water in the water storage cavity from flowing backward to water supply pipes and polluting the water source when water supply pipes connected with the water inlet pipe have a negative pressure.

DETAILED DESCRIPTION OF THE EMBODIMENTS

Figure 1:
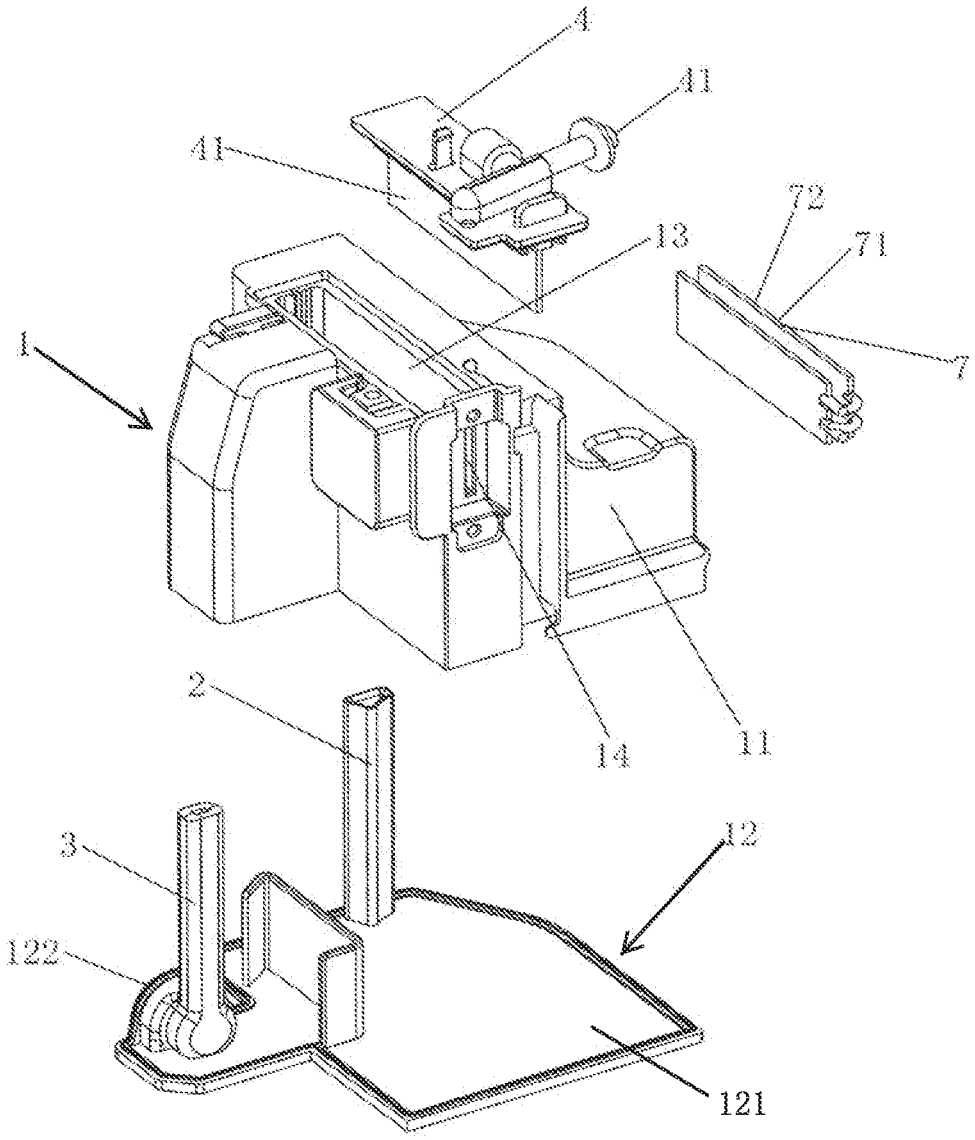
FIG. 1 illustrates an exploded view of a heating device of the present disclosure in embodiment 1.

The present disclosure will be further described below in combination with the accompanying drawings and embodiments.

Embodiment 1

Referring to FIGS. 1-9, a water storage device of the present disclosure that achieves an integrated structure is disposed in a cleaning water path of a sanitary cleaning device, and the water storage device comprises a water tank 1 for storing cleaning water. The water tank 1 comprises a water inlet structure, a water storage cavity 15 for storing cleaning water, and a heating cavity 13 for receiving a heat source and discharging water (i.e., the cleaning water that has been heated). The water inlet structure is in communication with the water storage cavity 15, and the water storage cavity 15 is in communication with the heating cavity 13.

In this embodiment, the water tank 1 further comprises a water outlet cavity 16 which is located at a top of the water tank 1 and in communication with the heating cavity 13. The top of the heating cavity 13 comprises a top opening, but the disclosure is not limited to this. In other embodiments, the top of the heating cavity 13 is closed. The water outlet cavity 16 is located on a side surface of the heating cavity 13. The present disclosure also discloses an end cover 4 that is connected to the water tank 1 and closes the top opening of the heating cavity 13. The end cover 4 comprises a water passage 41, and a first end of the water passage 41 is in communication with the water outlet cavity 16. The end cover 4 is used to assist in fixing the heat source. The setting of the end cover 4 makes a positioning of the heat source more convenient and reliable, and at the same time facilitates later maintenance and regular removal of scale.

A side wall of the water tank 1 comprises a heat source installation port 14, and the heat source installation port 14 is in communication with the heating cavity 13.

In this embodiment, the water tank 1 further comprises an overflow structure in communication with the water storage cavity 15, and a water outlet surface of the water inlet structure is higher than an overflow surface of the overflow structure.

In this embodiment, the water inlet structure includes a water inlet pipe 3. A first end of the water inlet pipe 3 comprises a second water outlet 31 located in the water storage cavity 15, and a water outlet surface of the second water outlet 31 defines the water outlet surface of the water inlet structure. A second end of the water inlet pipe 3 comprises a second water inlet 32 leading to outside of the water tank 1. The water outlet surface of the second water outlet 31 refers to a surface on which an end edge of the second water outlet 31 is located. In other embodiments, the water inlet structure is a water inlet disposed on the side wall or a top wall of the water tank 1, and the water outlet surface of the water inlet structure is a surface on which an inner edge of the water inlet is located.

Figure 2:
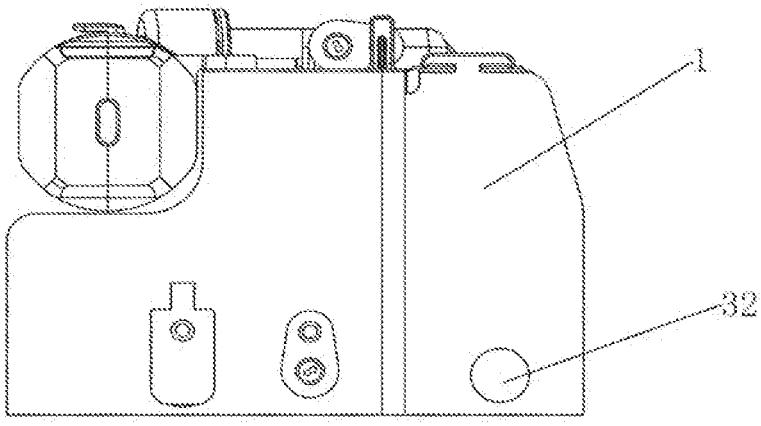
FIG. 2 illustrates a side view of the heating device of the present disclosure in embodiment 1.
Figure 3:
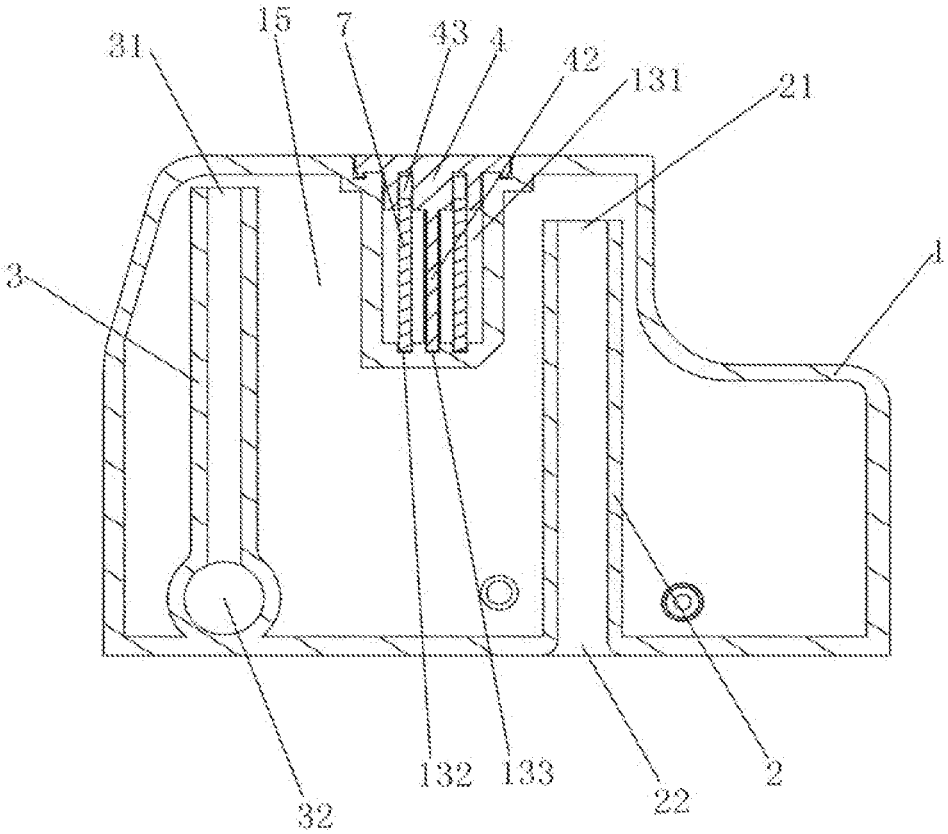
FIG. 3 illustrates a first cross-sectional view of the heating device of the present disclosure in embodiment 1.
Figure 4:
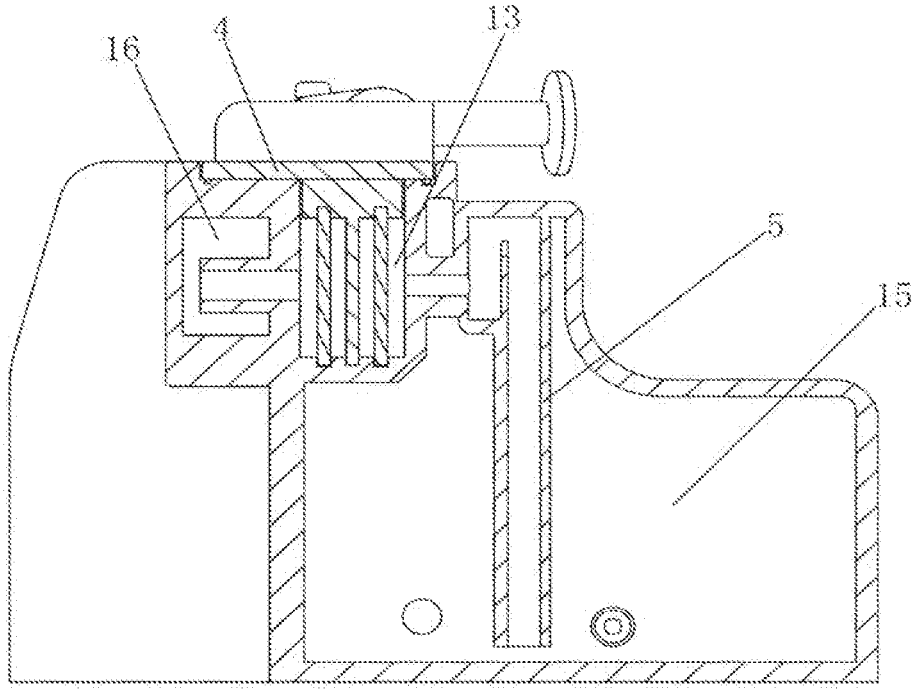
FIG. 4 illustrates a second cross-sectional view of the heating device of the present disclosure in embodiment 1.
Figure 5:
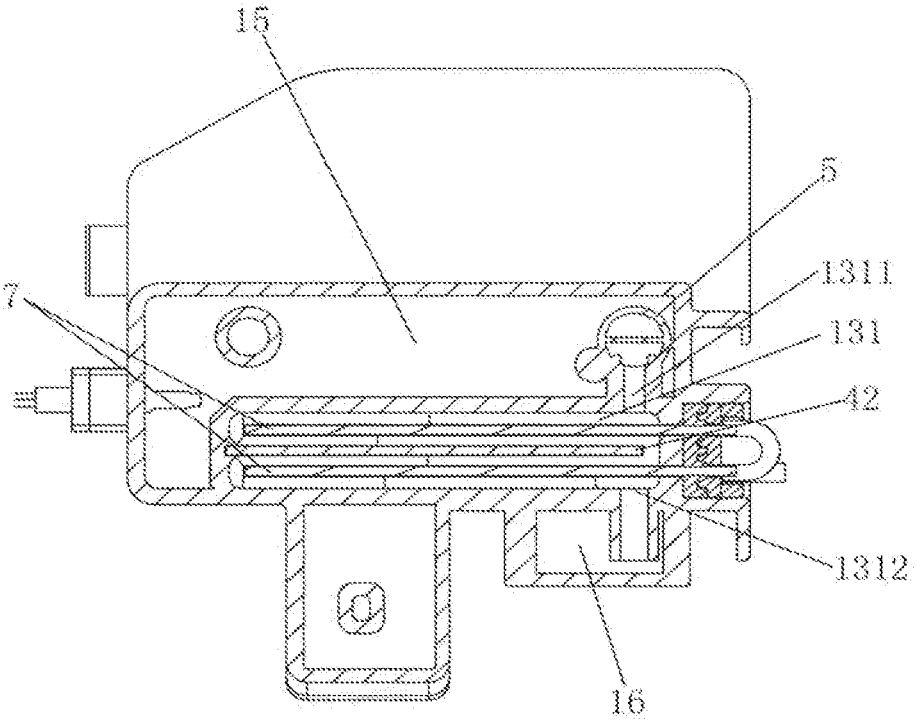
FIG. 5 illustrates a third cross-sectional view of the heating device of the present disclosure in embodiment 1.

In this embodiment, the second water inlet 32 is located on the side wall of the water tank 1, as shown in FIG. 2, but the disclosure is not limited in this regard. In other embodiments, the second water inlet 32 is located on a bottom wall or the top wall of the water tank 1.

Referring to FIGS. 1-9, a heating device of the present disclosure comprises a main body and one or more ceramic heating plates 7. The main body comprises the heating cavity 13, and the one or more ceramic heating plates 7 are disposed in the heating cavity 13 of the main body to define a heating channel 131 within the heating cavity 13. A first end of the heating channel 131 has a first water inlet 1311, and a second end of the heating channel 131 has a first water outlet 1312. The one or more ceramic heating plates 7 comprise a first heating surface 71 and a second heating surface 72 that face away from each other. A flow direction of the cleaning water in the heating channel 131 is along the first heating surface 71 and the second heating surface 72 in sequence. Specifically, the flow direction of the cleaning water in the heating channel 131 is along a length direction of the first heating surface 71 and a length direction of the second heating surface 72 in sequence, but the disclosure is not limited in this regard. In other embodiments, the flow direction of the cleaning water in the heating channel 131 is along a width direction of the first heating surface 71 and a width direction of the second heating surface 72 in sequence. The main body comprises the water outlet cavity 16, and the water outlet cavity 16 is in communication with the first water outlet 1312. The main body is specifically the water tank 1, and the water tank 1 comprises the water storage cavity 15 that can be supplied with the cleaning water. The first water inlet 1311 of the heating channel 131 is in communication with the water storage cavity 15 through the water inlet structure.

In this embodiment, the one or more ceramic heating plates 7 are a plurality of ceramic heating plates 7, and the plurality of ceramic heating plates 7 are disposed side by side. One of one or more partitions 42 is disposed between adjacent ceramic heating plates 7 of the plurality of ceramic heating plates 7, and the one or more partitions 42 are parallel to the plurality of ceramic heating plates 7. There are gaps between each of the plurality of ceramic heating plates 7 and the one or more partitions 42 that is adjacent to each of the plurality of ceramic heating plates 7, so that the heating channel 131 that is serpentine-shaped surrounding each of the plurality of ceramic heating plates 7. A side of the water tank 1 comprises the heat source installation port 14 in communication with the heating cavity 13 and used for receiving the plurality of ceramic heating plates 7. A cross section and a longitudinal section of the heating cavity 13 are substantially square, and each of the plurality of ceramic heating plates 7 is in a shape of a square flat plate. In other embodiments, the one or more ceramic heating plates 7 are a single ceramic heating plate 7.

In this embodiment, the plurality of ceramic heating plates 7 are in a standing state, and the water inlet structure and the water outlet cavity 16 are located on the side surface of the heating cavity 13. The heating cavity 13 has the top opening. The end cover 4 is connected to the water tank 1, and the end cover 4 closes the top opening of the heating cavity 13 and positions the plurality of ceramic heating plates 7. Specifically, a bottom surface of the heating cavity 13 comprises a plurality of first positioning grooves 132 in parallel, and a bottom surface of the end cover 4 comprises a plurality of second positioning grooves 43 in parallel. Bottom portions of the plurality of ceramic heating plates 7 are disposed in the plurality of first positioning grooves 132 in one to one correspondence, and top portions of the plurality of ceramic heating plates 7 are disposed in the plurality of second positioning grooves 43 in one to one correspondence. Top portions of the one or more partitions 42 are fixed to the end cover 4. Specifically, the one or more partitions 42 and the end cover 4 are integrally formed, but the disclosure is not limited in this regard. Bottom portions of the one or more partitions 42 are disposed in one or more third positioning groove 133 defined on the bottom surface of the heating cavity 13. The plurality of ceramic heating plates 7 are two ceramic heating plates 7, but the disclosure is not limited in this regard. The end cover 4 comprises the water passage 41, and a first end of the water passage 41 is in communication with the water outlet cavity 16. The first water outlet 1312 is located at or above a center of a side surface of the second end of the heating channel 131 to ensure that bubbles generated during a heating process can be brought out of the heating cavity 13 along a water flow at a uniform speed to prevent the bubbles generated during the heating process from accumulating. The first water inlet 1311 is located on a side surface of the first end of the heating channel 131.

In this embodiment, the heating cavity 13 is located at the top of the water tank 1, and the water outlet cavity 16 is also located at the top of the water tank 1. The water inlet structure comprises a water pumping pipe 5. A first end of the water pumping pipe 5 is in communication with the first water inlet 1311 of the heating channel 131, a second end of the water pumping pipe 5 extends into the water storage cavity 15, and the second end of the water pumping pipe 5 is lower than a lowest water level line of the water storage cavity 15. Specifically, the water pumping pipe 5 is erected in the water storage cavity 15. The heating cavity 13 is located at the top of the water tank 1, and the heating cavity 13 is in communication with the water storage cavity 15 through the water pumping pipe 5. In this way, it is possible to prevent the heating cavity 13 from always having water, thereby preventing the plurality of ceramic heating plates 7 in the heating cavity 13 from being immersed in water in a non-working state and making the plurality of ceramic heating plates 7 less prone to scaling. The second end of the water pumping pipe 5 is higher than a self-cleaning water outlet provided by a spray cleaning device of the sanitary cleaning device.

In this embodiment, a top of the water storage cavity 15 surrounds or partially surrounds the heating cavity 13, and a highest water level of the water storage cavity 15 is higher than a bottom end of the heating cavity 13. In this way, not only can an external heat dissipation of the heating cavity 13 be used to preheat the cleaning water in the water storage cavity 15 to achieve energy savings, but also the cleaning water (i.e., at a room temperature) in the water storage cavity 15 can be used to protect the plurality of ceramic heating plates 7 when the plurality of the ceramic heating plates 7 in the heating cavity 13 is in an abnormal heating condition. That is, when the plurality of ceramic heating plates 7 are abnormally heated to cause the water temperature to be too high, the cleaning water at the room temperature in the water storage cavity 15 can be used to cool the heating cavity 13 to a certain extent, thereby avoiding the plurality of ceramic heating plates 7 from being easily damaged due to overheating.

In this embodiment, the water tank 1 comprises an overflow structure, and the overflow structure is specifically an overflow pipe 2. A top end of the overflow pipe 2 comprises an overflow port 21 located in the water storage cavity 15. A bottom end of the overflow pipe 2 comprises a drain port 22 leading to outside of the water tank 1. Specifically, the drain port 22 is located on a bottom wall of the water tank 1, but the disclosure is not limited in this regard. In other embodiments, the drain port 22 is located at a bottom of the side wall of the water tank 1. In other embodiments, the overflow structure is an overflow port disposed on the side wall of the water tank 1.

In this embodiment, the overflow pipe 2 is adjacent to an inner side of the water tank 1, so that the overflow pipe 2 can allow a larger space inside the water tank 1 to facilitate an installation of other components. Specifically, the overflow pipe 2 is adjacent to an inner surface of an upper shell described below. The overflow pipe 2 is away from the second water outlet 31 of the water inlet pipe 3, so that when the cleaning water enters into the water inlet pipe 3, a wave of water surface near the water inlet pipe 3 will not cause the cleaning water to flow out of the overflow pipe 2, thereby reducing water loss.

In this embodiment, the water tank 1 comprises a bottom plate 12 and an upper shell 11 having a bottom end opening. The bottom plate 12 is sealingly connected to the bottom end opening of the upper shell 11, and the water storage cavity 15 is surrounded and defined by the bottom plate 12 and the upper shell 11. All sides of the bottom plate 12 are fixed to the upper shell 11 by ultrasonic welding. The heating cavity 13 and the water outlet cavity 16 are located in the upper shell 11, and the water pumping pipe 5 is disposed on the upper shell 11. Specifically, the water pumping pipe 5 and the upper shell 11 are integrally molded by injection molding, but the disclosure is not limited thereto. The end cover 4 covers the upper shell 11. The overflow pipe 2 and the water inlet pipe 3 are erected on the bottom plate 12, and the overflow pipe 2, the water inlet pipe 3, and the bottom plate 12 are integrally molded by injection molding, but the disclosure is not limited in this regard. The bottom plate 12 specifically comprises a flat main plate 121 and a small side wall 122 protruding from an edge of a top surface of the flat main plate 121. The flat main plate 121 defines the bottom wall of the water tank 1, and all side walls of the upper shell 11 and the small side wall 122 define the side wall of the water tank 1. The second water inlet 32 of the water inlet pipe 3 is located on the small side wall 122.

When the heating device of the present disclosure is in application, a second end of the water passage 41 of the end cover 4 is in communication with a water inlet port of the water pump.

Figure 6:
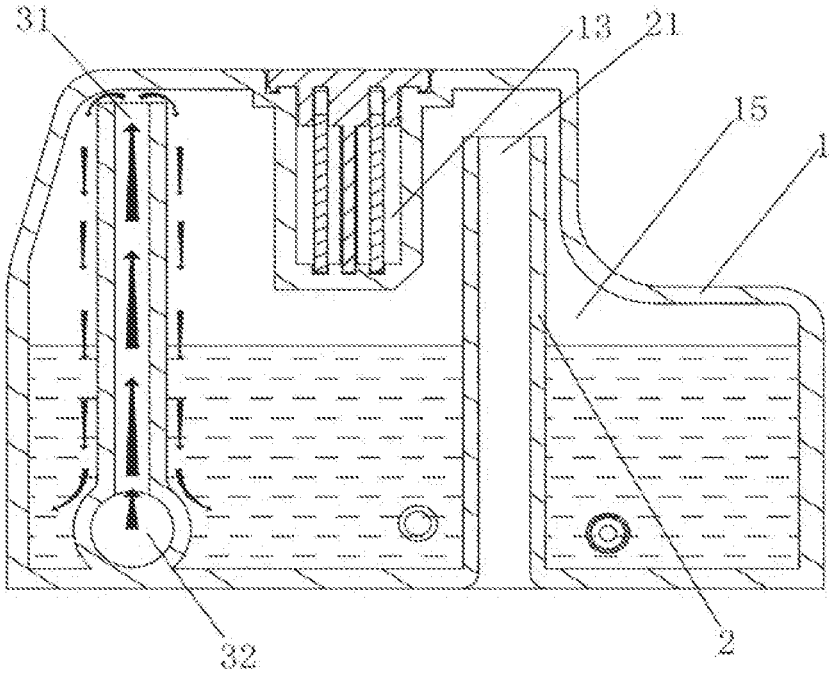
FIG. 6 illustrates a cross-sectional view of the heating device of the present disclosure in embodiment 1 when the heating device is in a water intake process.
Figure 7:
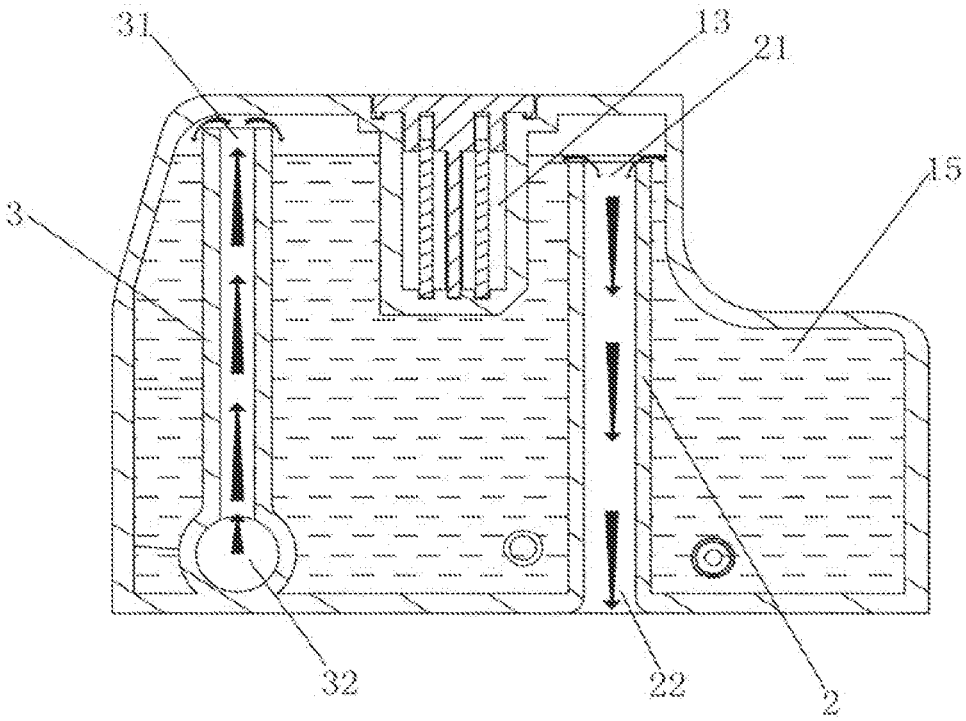
FIG. 7 illustrates a cross-sectional view of the heating device of the present disclosure in embodiment 1 when the heating device is in a water overflow process.
Figure 8:
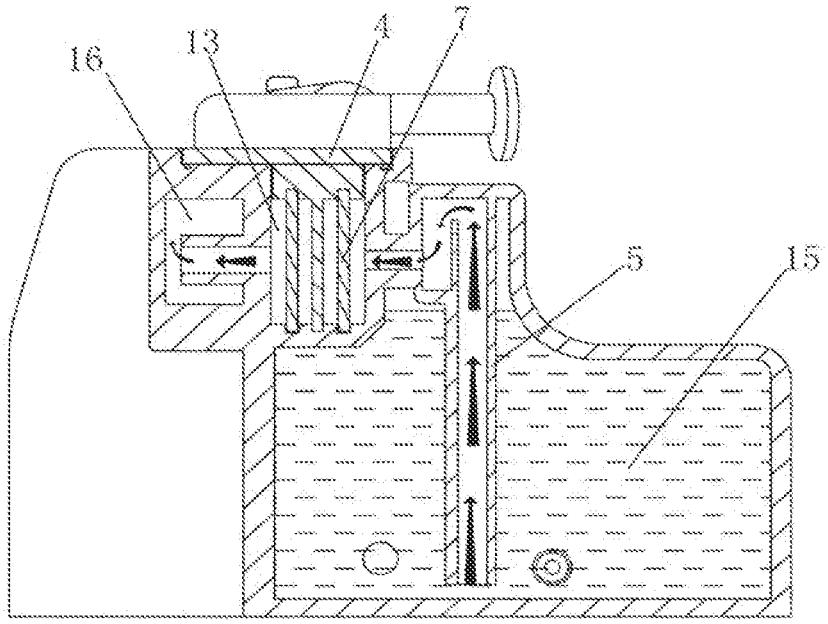
FIG. 8 illustrates a cross-sectional view of the heating device of the present disclosure in embodiment 1 when the heating device is in a water pumping process.

When the cleaning water enters from the second water inlet 32, the cleaning water flows upward along an internal passage of the water inlet pipe 3, and finally flows out from the second water outlet 31 of the water inlet pipe 3 and falls into the water storage cavity 15, as shown in FIG. 6. During a water inflow process, air in the water storage cavity 15 is gradually squeezed and discharged from the overflow pipe 2. When a device for controlling the water inflow process (the device may include, for example, a water level detector arranged in the water tank 1, a solenoid valve arranged at the second water inlet 32, and a controller that coordinates working status of the water level detector and the solenoid valve, etc.) fails, causing the second water inlet 32 to continue to be supplied with the cleaning water and causing the cleaning water in the water storage cavity 15 to exceed the maximum water level line, and the cleaning water, that exceeds the maximum water level, will enter the overflow port 21 at the top end of the overflow pipe 2, flow along an internal channel of the overflow pipe 2 to the drain port 22, as shown in FIG. 7, and finally fall into a toilet tank.

Since the second water outlet 31 is higher than the overflow port 21, the second water outlet 31 will not be submerged in the cleaning water, but rather the second water outlet 31 will be disposed in an air layer above the overflow port 21. As a result, when there is a negative pressure in the water supply pipe of that is connected to the second water inlet 32, the cleaning water in the water tank 1 will not flow back, thereby avoiding pollution of the water source. The overflow pipe 2 has functions of exhausting air and overflowing water, and when the overflow pipe 2 performs the function of overflowing water, the cleaning water can be directly discharged into the toilet tank without the toilet tank being connected to other pipelines, so that an appearance of the water tank 1 of the present disclosure is more concise and beautiful. Additionally, the water tank 1 is easier to assemble.

Figure 9:
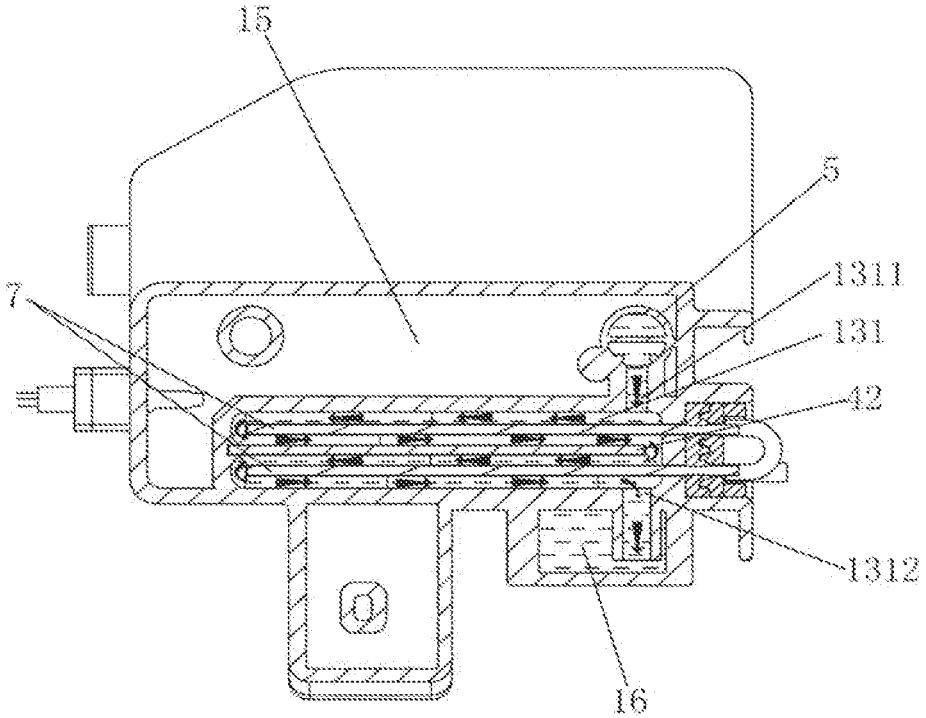
FIG. 9 illustrates a cross-sectional view of the heating device of the present disclosure in embodiment 1, illustrating a flow direction of cleaning water in a heating channel of the heating device.
Figure 10:
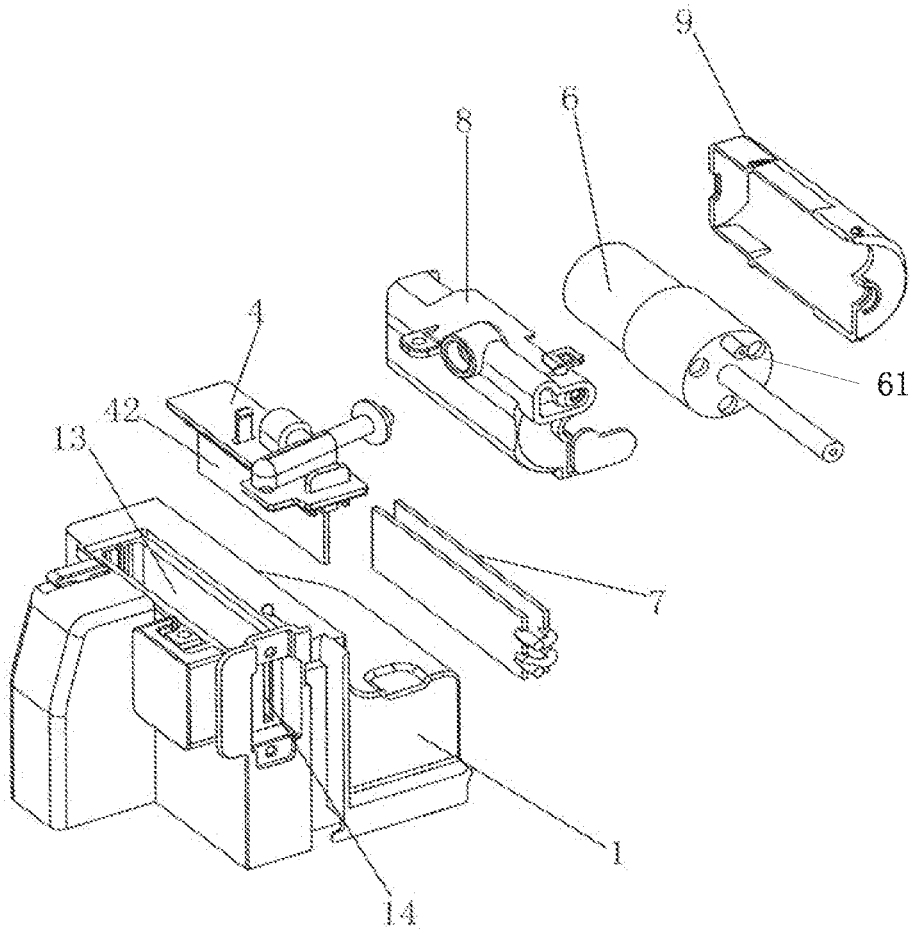
FIG. 10 illustrates an exploded view of a sanitary water supply device of the present disclosure in embodiment 1.
Figure 11:
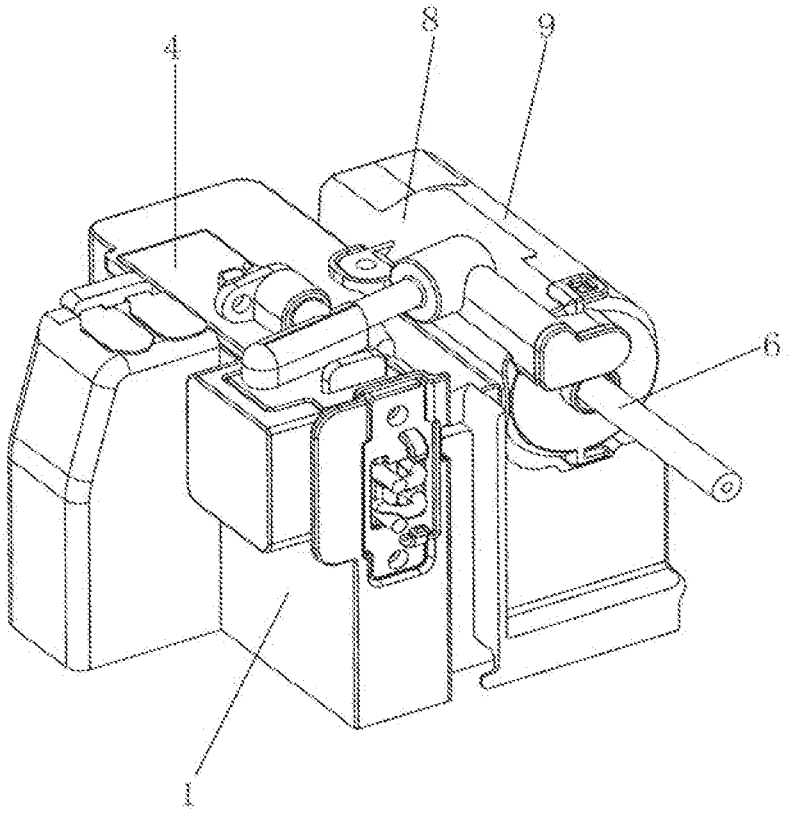
FIG. 11 illustrates a perspective view of the sanitary water supply device of the present disclosure in embodiment 1.

When the cleaning water is pumped under an action of the water pump, the cleaning water in the water storage cavity 15 flows into the heating cavity 13 through the water pumping pipe 5, flows along the heating channel 131, which is serpentine-shaped, to be rapidly heated by the one or more ceramic heating plates 7, as shown in FIG. 9, and finally passes through the water outlet cavity 16, the water passage 41 of the end cover, and the water pump in sequence to be output.

Since the water tank 1 comprises the heating cavity 13, the water tank 1 of the present disclosure can integrate the heating device of the prior art, thereby not only reducing parts and assembly steps of the heating device to save costs, but also making an overall structure of the sanitary cleaning device having the water tank 1 more concise and occupy a smaller space.

The heating channel 131 that is serpentine-shaped increases a heating distance of the cleaning water in the heating cavity 13, so that the cleaning water is uniformly and fully heated in the heating cavity 13, and at the same time, the one or more ceramic heating plates 7 are completely immersed in the cleaning water to improve a heating efficiency of the one or more ceramic heating plates 7. In addition, the heating channel 131 surrounds the first heating surface 71 and the second heating surface 72 of the one or more ceramic heating plates 7, so that a cross-sectional area of the heating channel 131 is larger, and the heating channel 131 is not easily blocked by scale due to long-term use.

Referring to FIGS. 10-14, a sanitary water supply device of the present disclosure comprises a water pump 6 and the heating device of the present disclosure described in embodiment 1. The cleaning water received in the water storage cavity 15 is pumped through the water pump 6 to the heating cavity 13 and is output. Specifically, the water pump 6 is disposed on a downstream side of the heating device, that is, the first water outlet 1312 of the heating channel 131 is in communication with a water inlet port 61 of the water pump 6.

In this embodiment, the water pump 6 is disposed between two protective covers 8, 9, and the water inlet port 61 of the water pump 6 is in communication with the second end of the water passage 41 of the end cover 4 through a first protective cover 8 of the two protective covers 8, 9.

Figure 12:
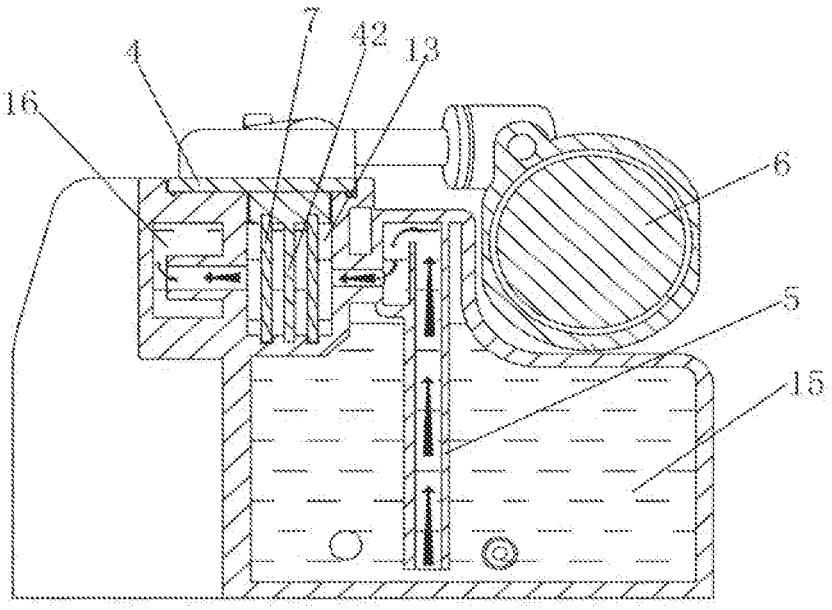
FIG. 12 illustrates a first cross-sectional view of the sanitary water supply device of the present disclosure in embodiment 1 when the sanitary water supply device is in a water pumping process.
Figure 13:
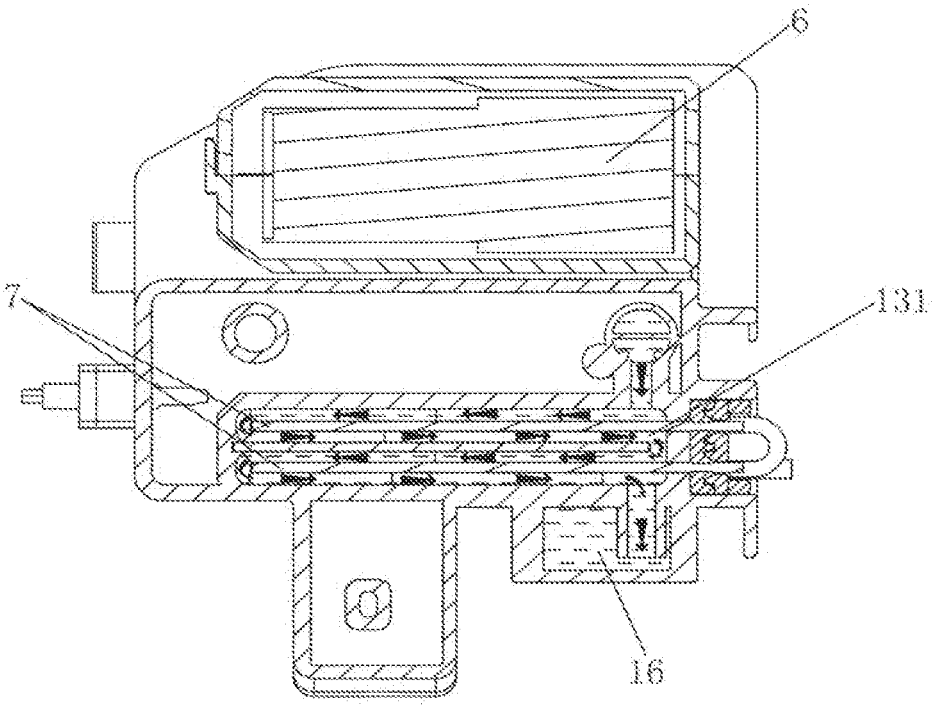
FIG. 13 illustrates a second cross-sectional view of the sanitary water supply device of the present disclosure in embodiment 1 when the sanitary water supply device is in the water pumping process.
Figure 14:
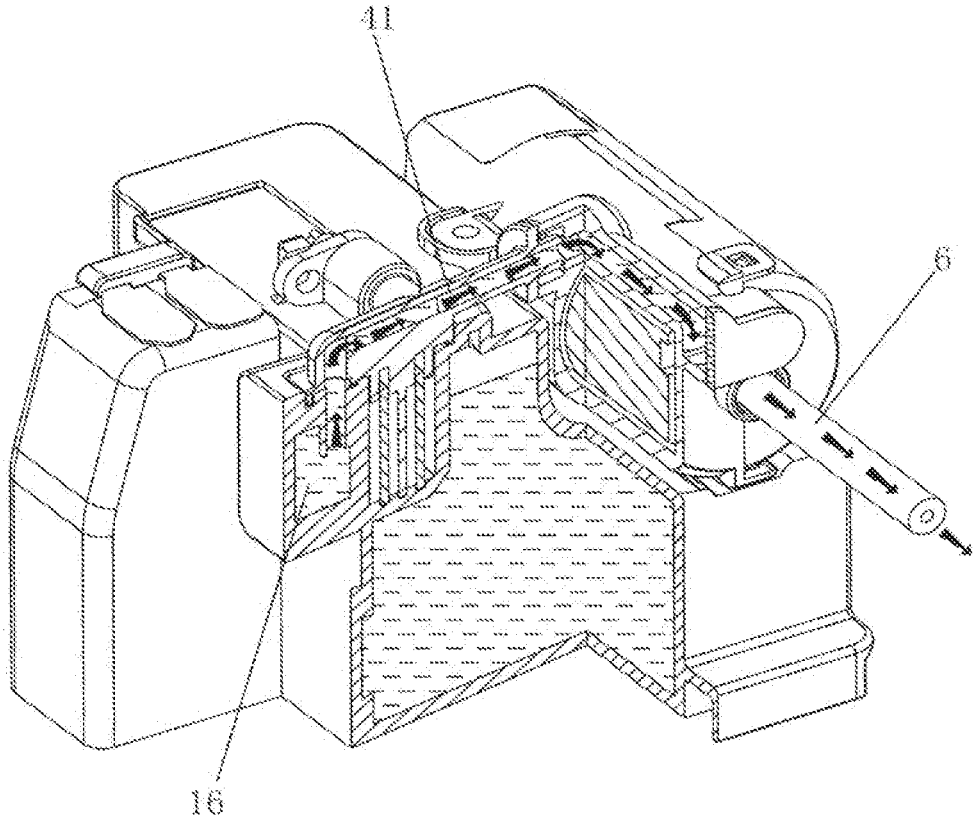
FIG. 14 illustrates a third cross-sectional, perspective view of the sanitary water supply device of the present disclosure in embodiment 1 when the sanitary water supply device is in the water pumping process.

When the cleaning water is pumped under an action of the water pump 6, the cleaning water in the water storage cavity 15 flows into the heating cavity 13 through the water pumping pipe 5, flows along the heating channel 131, which is serpentine-shaped, to be rapidly heated by the one or more ceramic heating plates 7, and finally passes through the water outlet cavity 16, the water passage 41 of the end cover 4, and the water pump 6 in sequence to be output, as shown in FIGS. 12-14.

Figure 15:
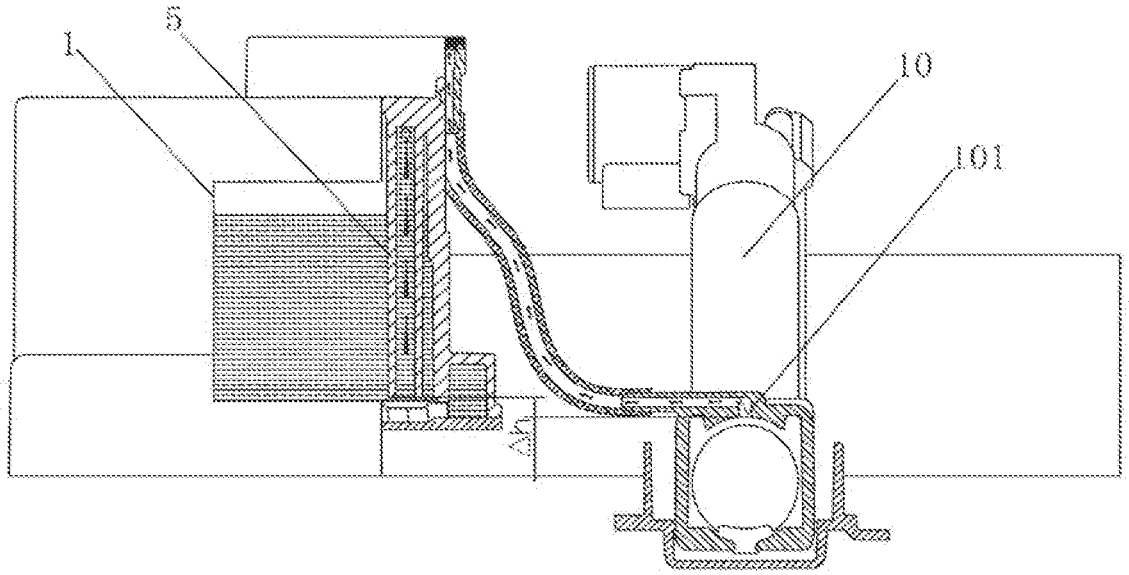
FIG. 15 illustrates a cross-sectional view of the sanitary water cleaning device of the present disclosure in embodiment 1 when the sanitary water supply device is in a siphon water draining process.
Figure 16:
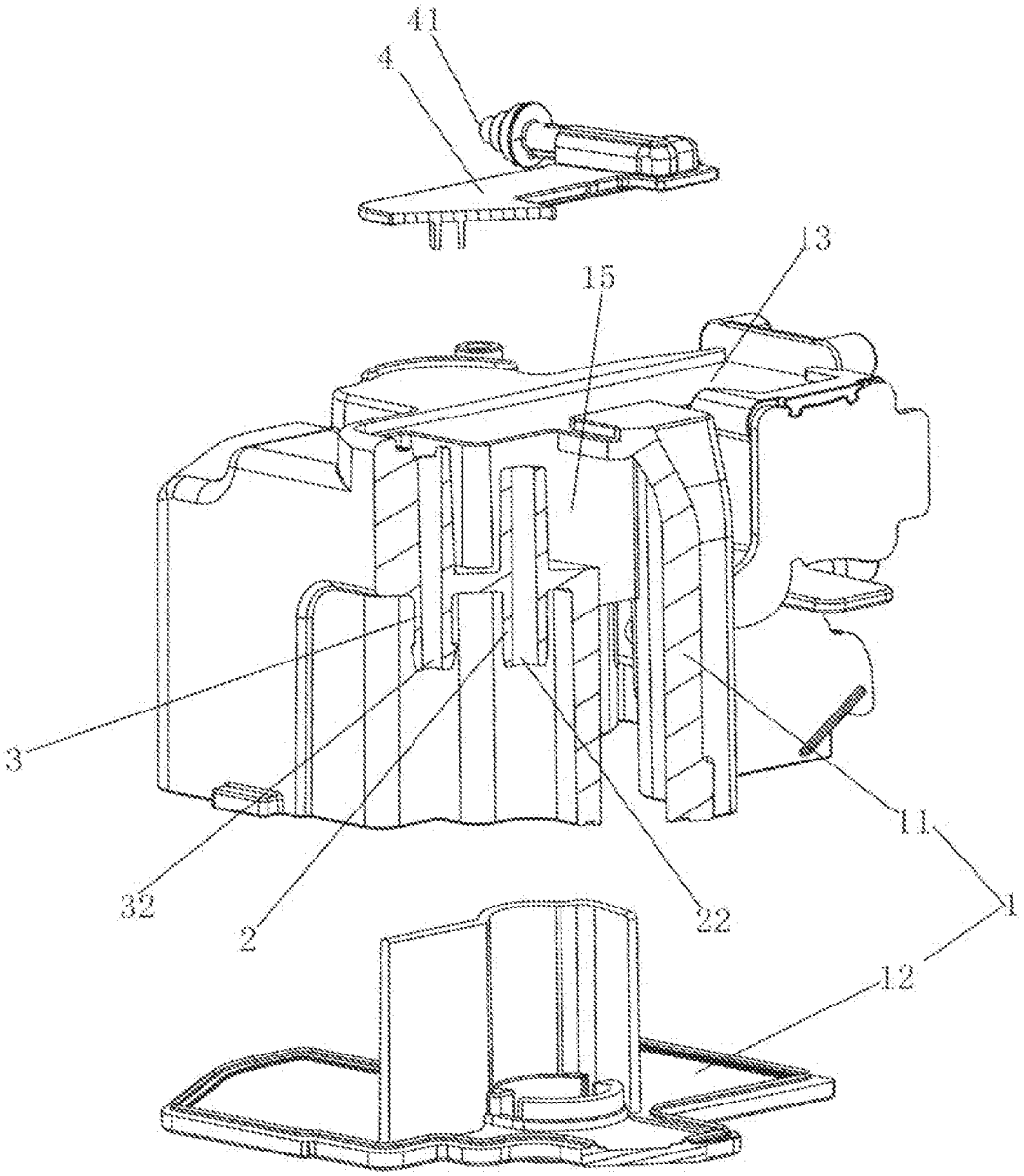
FIG. 16 illustrates an exploded view of a water tank of the present disclosure in embodiment 2.
Figure 17:
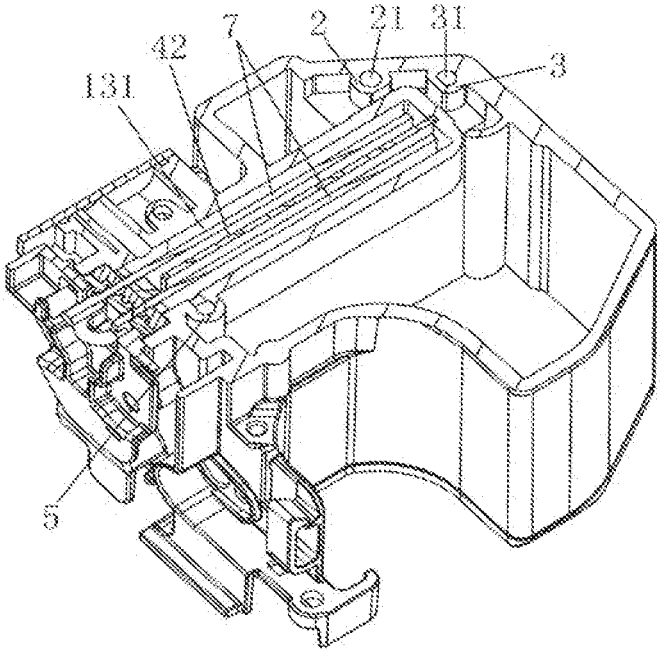
FIG. 17 illustrates a cross-sectional, perspective view of an upper shell of the present disclosure in embodiment 2.

Referring to FIG. 15, the sanitary cleaning device of the present disclosure comprises the spray cleaning device 10 for spraying the cleaning water and also comprises the sanitary water supply device of the present disclosure described in embodiment 1. The spray cleaning device 10 is disposed on a downstream side of the water pump 6. That is, the spray cleaning device 10 is in communication with a water outlet port of the water pump 6, and the spray cleaning device 10 sprays the cleaning water pumped by the water pump 6 to achieve hip washing or bidet washing.

In this embodiment, the second end of the water pumping pipe 5 is higher than the self-cleaning water outlet 101 of the spray cleaning device 10. During a spray cleaning process, when there is a sudden power failure/water cut, a siphon phenomenon is formed by a height difference $\Delta h$ between the second end of the water pumping pipe 5 (the second end of the water pumping pipe 5 is a suction port) and the self-cleaning water outlet 101 of the spray cleaning device 10, and the cleaning water remaining in the water tank 1 will be drained due to the siphon phenomenon, as shown in FIG. 15, so as to ensure that the cleaning water remaining in the water tank 1 is drained in case of the sudden power failure/water cut.

In the sanitary cleaning device of the present disclosure, the parts not involved are the same as the prior art or can be realized by the prior art. For example, a liquid level detector for controlling a highest water level and a lowest water level is provided in the water storage cavity 15 of the water tank 1.

Embodiment 2

Referring to FIGS. 16-19, a heating device of the present disclosure is provided differs from the embodiment 1 described below. A bottom end of the water inlet pipe 3 extends outside of the water tank 1, so that the second water inlet 32 is located outside of the water tank 1. A bottom end of the overflow pipe 2 also extends outside of the water tank 1 so that the drain port 22 is located outside of the water tank 1.

In this embodiment, the water tank 1 also comprises the upper shell 11 and the bottom plate 12, and the overflow pipe 2 and the water inlet pipe 3 are all integrally molded by injection molding at a waist of the upper shell 11 and attached to an inner surface of the upper shell 11. The top of the water storage cavity 15 has an opening, and the opening is covered by the end cover 4.

In this embodiment, the one or more ceramic heating plates 7 also cooperate with the one or more partitions 42 to form the heating channel 131, which is serpentine-shaped in the heating cavity 13.

Figure 18:
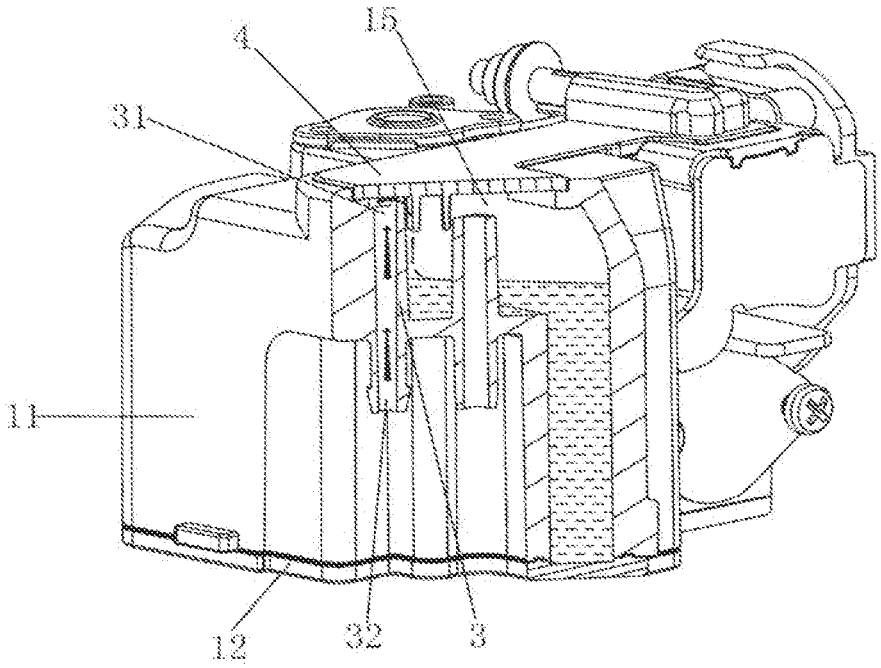
FIG. 18 illustrates a cross-sectional, perspective view of the water tank in a water intake process of the present disclosure in embodiment 2.
Figure 19:
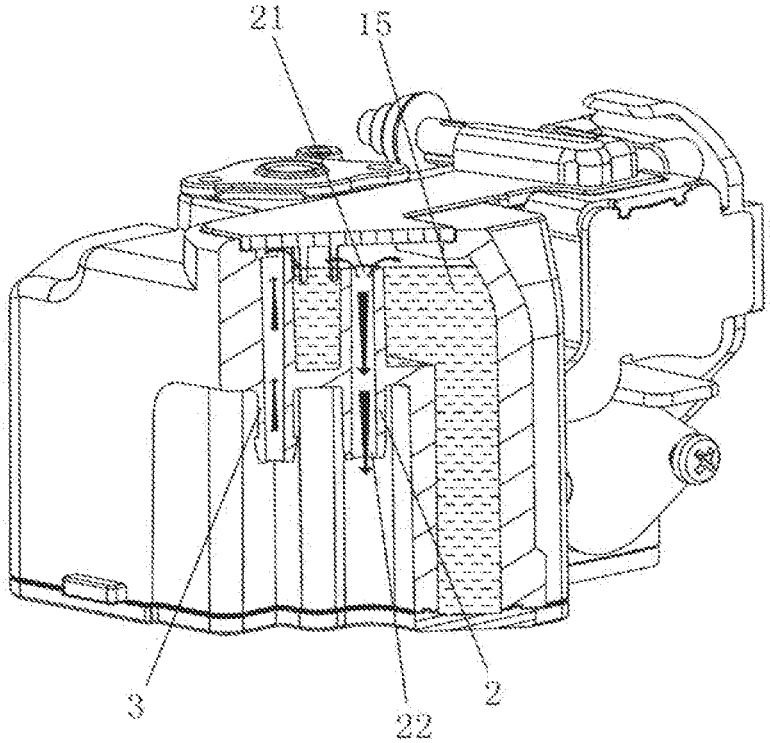
FIG. 19 illustrates a cross-sectional, perspective view of the water tank in a water overflow process of the present disclosure in embodiment 2.

When the cleaning water enters from the second water inlet 32, the cleaning water flows upward along the internal passage of the water inlet pipe 3, flows out from the second water outlet 31 of the water inlet pipe 3, and finally falls into the water storage cavity 15, as shown in FIG. 18. During the water intake process, the air in the water storage cavity 15 is gradually squeezed and discharged from the overflow pipe 2. When the device for controlling the water intake process (the device generally includes the water level detector arranged in the water tank 1, the solenoid valve arranged at the second water inlet 32, and the controller that coordinates the working status of the water level detector and the solenoid valve) fails, causing the second water inlet 32 to continue to be supplied with the cleaning water and causing the cleaning water in the water storage cavity 15 to exceed the maximum water level line, the cleaning water which exceeds the maximum water level will enter the overflow port 21 at the top end of the overflow pipe 2, flow along the internal passage of the overflow pipe 2 to the drain port 22, as shown in FIG. 19, and finally fall into the toilet tank.

When the cleaning water is pumped under the action of the water pump connected to the water passage 41 of the end cover 4, the cleaning water in the water storage cavity 15 flows into the heating cavity 13 through the water pumping pipe 5, flows along the heating channel 131, which is serpentine-shaped, to be rapidly heated by the one or more ceramic heating plates 7, and is finally output by the water pump.

Figure 20:
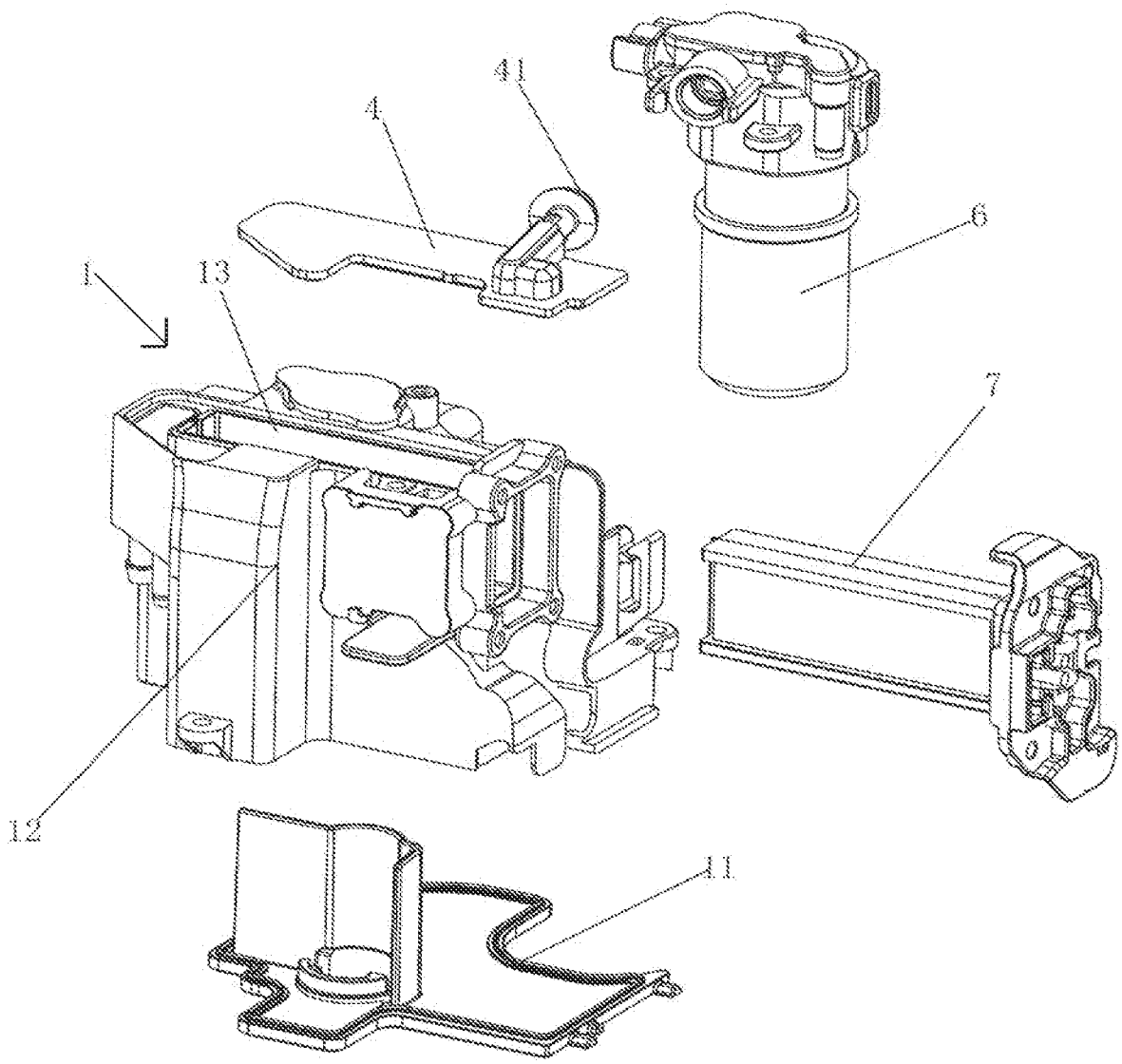
FIG. 20 illustrates an exploded view of a sanitary water supply device of the present disclosure in embodiment 2.

Referring to FIG. 20, a sanitary water supply device of the present disclosure comprises a water pump 6, the heating device of the present disclosure in embodiment 2 described above, and the water storage device having the integrated structure. The cleaning water received in the water storage cavity 15 is pumped by the water pump 6 into the heating cavity 13 and is output. Specifically, the water pump 6 is fixed outside of the water tank 1 and in communication with the second end of the water passage 41 of the end cover 4.

When the cleaning water is pumped under an action of the water pump 6, the cleaning water in the water storage cavity 15 flows into the heating cavity 13 through the water pumping pipe 5, flows along the heating channel 131, which is serpentine-shaped, to be rapidly heated by the one or more ceramic heating plates 7, and finally is output through the water outlet cavity 16, the water passage 41 of the end cover 4, and the water pump 6 in sequence.

A sanitary cleaning device of the present disclosure comprises a spray cleaning device for spraying the cleaning water and further comprises the sanitary water supply device of the present disclosure in embodiment 2 described above. The spray cleaning device is in communication with an outlet port of the water pump 6, and the cleaning water is pumped by the water pump 6 to be sprayed to realize hip washing or feminine washing.

Embodiment 3

A heating device of the present disclosure differs from the above embodiments in that the main body is not the water tank 1, but is separate from the water tank.

A sanitary water supply device of the present disclosure comprises a water tank 1, a water pump 6, and the heating device of the present disclosure described in embodiment 1. The cleaning water received in the water tank 1 is pumped by the water pump 6 to the heating cavity and is output. Specifically, the water tank 1 is disposed on an upstream side of the heating device, and the water pump 6 is disposed on the downstream side of the heating device.

A sanitary cleaning device of the present disclosure comprises a spray cleaning device for spraying the cleaning water and also comprises the sanitary water supply device of the present disclosure in embodiment 3 described above. The spraying device is in communication with the outlet water port of the water pump 6, and the cleaning water is pumped by the water pump 6 to be sprayed to realize hip washing or feminine washing.

The above embodiments are only used to further illustrate a heating device, a sanitary water supply device, and a sanitary cleaning device of the present disclosure, but the present disclosure is not limited to the embodiments. Thus, it is intended that the present disclosure cover any modifications and variations of the presently presented embodiments provided they are made without departing from the appended claims and the specification of the present disclosure.

What is claimed is:

1. A heating device, comprising:
a main body, and
one or more ceramic heating plates, wherein:
the main body comprises a heating cavity,
the one or more ceramic heating plates are disposed in the heating cavity to define a heating channel within the heating cavity,
a first end of the heating channel has a first water inlet,
a second end of the heating channel has a first water outlet,
the one or more ceramic heating plates comprise a first heating surface and a second heating surface which face away from each other,
a flow direction of cleaning water in the heating channel is along the first heating surface and the second heating surface in sequence,
the main body is a water tank,
the water tank comprises a water storage cavity that is configured to receive the cleaning water,
the heating cavity is located at a top of the water tank,
the water tank comprises a water pumping pipe,
a first end of the water pumping pipe is in communication with the first water inlet of the heating channel, and
a second end of the water pumping pipe extends into the water storage cavity.

2. The heating device according to claim 1, wherein:
the one or more ceramic heating plates are a plurality of ceramic heating plates,
the plurality of ceramic heating plates are disposed side by side, and
one of one or more partitions is disposed between a respective two, which are adjacent to each other, of the plurality of ceramic heating plates to make the heating channel that is serpentine-shaped surround each of the plurality of ceramic heating plates.

3. The heating device according to claim 2, wherein:
the plurality of ceramic heating plates are in a standing state, and
a water inlet structure and a water outlet structure are located on a side surface of the heating cavity.

4. The heating device according to claim 3, wherein:
a top end of the heating cavity has an opening,
an end cover is connected to the main body, and
the end cover is configured to close the opening.

5. The heating device according to claim 4, wherein:
a bottom surface of the heating cavity comprises a plurality of first positioning grooves disposed side by side,
a bottom surface of the end cover comprises a plurality of second positioning grooves disposed side by side,
bottom portions of the plurality of ceramic heating plates are disposed in the plurality of first positioning grooves in a one to one correspondence,
top portions of the plurality of ceramic heating plates are disposed in the plurality of second positioning grooves in a one to one correspondence,
top portions of the one or more partitions are fixed to the end cover, and
bottom portions of the one or more partitions are disposed in one or more third positioning grooves defined on the bottom surface of the heating cavity.

6. The heating device according to claim 4, wherein:
the main body comprises a water outlet cavity which is in communication with the first water outlet,
the end cover comprises a water passage, and
a first end of the water passage is in communication with the water outlet cavity.

7. The heating device according to claim 1, wherein:
a side of the main body comprises a heat source installation port in communication with the heating cavity and used for receiving the one or more ceramic heating plates; or
the first water outlet is located at or above a center of the second end of the heating channel, and is located on a side surface of the second end of the heating channel.

8. The heating device according to claim 1, wherein:
the flow direction of the cleaning water in the heating channel is along a length direction of the first heating surface and a length direction of the second heating surface in sequence.

9. The heating device according to claim 1, wherein:
the first water inlet of the heating channel is in communication with the water storage cavity, and
the water tank, the water storage cavity, and the heating cavity are of an integrated structure.

10. The heating device according to claim 9, wherein:
the second end of the water pumping pipe is lower than a lowest water level line of the water storage cavity.

11. The heating device according to claim 10, wherein:
the second end of the water pumping pipe is higher than a self-cleaning water outlet provided by a spray cleaning device of a sanitary cleaning device comprising the heating device.

12. The heating device according to claim 10, wherein:
a top of the water storage cavity surrounds or partially surrounds the heating cavity, and
a highest water level line of the water storage cavity is higher than a bottom end of the heating cavity.

13. The heating device according to claim 9, wherein:
the water tank comprises an overflow pipe,
a top end of the overflow pipe comprises an overflow port located in the water storage cavity, and
a bottom end of the overflow pipe comprises a drain port leading to outside of the water tank.

14. The heating device according to claim 13, wherein:
the water tank comprises a water inlet pipe,
a first end of the water inlet pipe comprises a second water outlet located in the water storage cavity,
a second end of the water inlet pipe comprises a second water inlet leading to outside of the water tank, and
the second water outlet is higher than the overflow port.

15. A sanitary water supply device, comprising:
a water pump, and
the heating device according to claim 9, wherein:
the cleaning water received in the water storage cavity is configured to be pumped by the water pump to the heating cavity and to be output.

16. A sanitary water supply device, comprising:
a water pump, and
the heating device according to claim 1, wherein:
the cleaning water received in the water tank is configured to be pumped by the water pump to be output.

17. A sanitary cleaning device, comprising:
a spray cleaning device, and
the sanitary water supply device according to claim 15, wherein:
the spray cleaning device is disposed on a downstream side of the water pump.

* * * * *